US005252119A

United States Patent [19]

Nishida et al.

[11] Patent Number: 5,252,119

[45] Date of Patent: Oct. 12, 1993

[54] HIGH SPEED TOOL STEEL PRODUCED BY SINTERING POWDER AND METHOD OF PRODUCING SAME

[75] Inventors: Junichi Nishida, Yasugi; Norimasa Uchida, Yonago, both of Japan

[73] Assignee: Hitachi Metals, Ltd., Tokyo, Japan

[21] Appl. No.: 784,587

[22] Filed: Oct. 29, 1991

[30] Foreign Application Priority Data

Oct. 31, 1990 [JP] Japan ..... 2-294313
Mar. 5, 1991 [JP] Japan ..... 3-064097
Mar. 5, 1991 [JP] Japan ..... 3-064098

[51] Int. Cl.[5] ..... C22C 29/02

[52] U.S. Cl. ..... 75/236; 75/239; 75/240; 75/243; 75/246; 419/6; 419/11; 419/23; 419/14; 419/28; 419/29; 419/53

[58] Field of Search ..... 75/236, 246–248, 75/239, 240, 243, 6, 11, 23, 14, 53, 28, 29

[56] References Cited

U.S. PATENT DOCUMENTS

| | | | |
|---|---|---|---|
| 4,032,302 | 6/1977 | Nakamura et al. | 75/240 |
| 4,121,929 | 10/1978 | Kawai et al. | 75/238 |
| 4,121,930 | 10/1978 | Yukawa et al. | 75/238 |
| 4,140,527 | 2/1979 | Kawai et al. | 75/244 |
| 4,863,515 | 9/1989 | Roberts et al. | 75/238 |
| 4,880,461 | 11/1989 | Uchida | 75/238 |
| 4,936,911 | 6/1990 | Roberts et al. | 75/238 |
| 4,964,908 | 10/1990 | Greetham | 75/241 |
| 5,021,085 | 6/1991 | Karagoz et al. | 75/239 |
| 5,106,576 | 4/1992 | Noda et al. | 419/8 |

FOREIGN PATENT DOCUMENTS

| | | |
|---|---|---|
| 0322397 | 11/1988 | European Pat. Off. . |
| 0377307 | 12/1989 | European Pat. Off. . |
| 55-148747 | 11/1980 | Japan . |
| 57-2142 | 1/1982 | Japan . |
| 58-73753 | 5/1983 | Japan . |
| 58-117863 | 7/1983 | Japan . |
| 1-212736 | 8/1989 | Japan . |

*Primary Examiner*—Donald P. Walsh
*Assistant Examiner*—Ngoclan T. Mai
*Attorney, Agent, or Firm*—Finnegan, Henderson, Farabow, Garrett & Dunner

[57] ABSTRACT

A high speed tool steel produced by sintering powder, consisting essentially, by weight, of more than 1.5% but not more than 2.2% C, not more than 1.0% Si, not more than 0.6% Mn, 3.0 to 6.0% Cr, an amount of W and Mo in which the content of W+2Mo is in the range of 20 to 30% and in which the ratio of W/2Mo is not less than 1, not more than 5.0% V, 2.0 to 7.0% Nb, the ratio of Nb/V being not less than 0.5, and the balance Fe and incidental impurities, the value of C-Ceq, which Ceq is defined by $0.24+0.033\times W+0.063\times Mo+0.2\times V+0.1\times Nb$, being in a range of −0.20 to 0.05, the density of carbides in the sintered steel having grain size of 2 to 5 μm being in a range of 10,000 to 30,000 pieces/mm$^2$.

11 Claims, 1 Drawing Sheet

X1000

MC

X1000

$M_6C$

X1000

MC

X1000

$M_6C$

HIGH SPEED TOOL STEEL PRODUCED BY SINTERING POWDER AND METHOD OF PRODUCING SAME

BACKGROUND OF THE INVENTION

1. Field of the Invention

The present invention relates to high speed tool steel produced by sintering powder for use in a cutting tool or a cold heading tool and exhibiting both excellent wear resistance and satisfactory toughness under a high speed operational condition in which hardness and wear resistance are required at high temperature and a method of producing the same.

2. Related Art

High speed tool steel for use in a cutting tool or a cold heading tool must exhibit superior wear resistance with high hardness and excellent toughness.

There have been disclosed a variety of methods of improving the toughness of high speed tool steel produced by melting; for example, there has been disclosed a method in which Nb and other elements are added to make crystal grains fine in size to improve toughness (as shown in Japanese Patent Laid-Open No. 58-73753 and Japanese Patent Laid-Open No. 58-117863). Another method has been disclosed in which Nb and rare earth element are added to provide MC-type carbides finely distributed uniformly which carbides are mainly composed of Nb, to thereby improve toughness (as disclosed in Japanese Patent Publication No. 61-896).

On the other hand, regarding the improvement of wear resistance, in a case of high speed tool steel produced by sintering powder, in which steel it is possible to uniformly distribute fine carbide grains and to make the crystal grains fine in size, it has been most usual to increase the amount of carbides. For example, in Japanese Patent Publication Nos. 57-2142 and 55-148747, W equivalent mainly made to be in a high level to thereby increase the amount of $M_6C$-type carbides mainly composed of W and/or Mo, so that wear resistance is improved because of increased hardness.

Furthermore, in a high speed tool steel produced by sintering powder, it is proposed to add Nb for the purposes of making crystal grains fine in size and preventing grains from becoming coarse in size even when austenitizing temperature is high level as shown in Metall. Trans. 19A (1988) p. 1395 to 1401 and Japanese Patent Laid-Open No. 1-212736).

However, in the high speed tool steel produced by melting in Japanese Patent Laid-Open Nos. 58-73753 and 58-117863, the excessive addition of Nb causes the occurrence of crystallized coarse carbides of NbC essentially composed of Nb. Also coarse carbides are, at the time of the solidification, crystallized which are $M_6C$-type carbides essentially composed of W and Mo. Therefore, the effect of improving toughness by making crystal grains fine is diminished, with the result that the toughness is undesirably deteriorated.

Furthermore, although in the high speed tool steel produced by sintering powder it has been effected to increase the quantity of carbides or to make the hardness of the tool high for improving wear resistance, toughness is undesirably deteriorated, causing a problem of a breakage or cracking of the tool.

In the high speed tool steel of the Japanese Patent Laid-Open No. 55-148747 produced by sintering powder to which Nb is added, Nb is only intended to form hard carbide by adding Nb in place of V.

In the high speed tool steel disclosed in Metall. Trans. 19A (1988) p. 1395 to 1401 and Japanese Patent Laid-Open No. 1-212736, the addition of Nb makes it possible to enhance the quenching temperature while preventing the coarsening of crystal grains. However, the inventors of the present invention have found that in that steel there is insufficient resistance to softening upon high temperature-tempering, such resistance is required at the high temperatures encountered in a severe use thereof. This is due to the low content of alloying elements, in particular, due to low level of W equivalent, and wear resistance is also insufficient due to the small amount of carbides.

Therefore, the above-shown conventional high speed tool steel cannot satisfy the tool usage condition required in recent years in which a higher speed operation is needed.

SUMMARY OF THE INVENTION

To this end, an object of the present invention is to obtain high speed tool steel with high toughness produced by sintering powder which steel is provided with not only remarkably improved resistance to softening on high temperature tempering so as to withstand the higher speed condition of the tool, but also higher density of carbides of 2 to 5 $\mu$m size so as to further increase wear resistance.

Recently, there has been a great desire of improving the hardness of tools as tools are used at very high speed. The inventors of the present invention studied the relationship between the service life of a tool and the material through actual experiments by using tools such as an end mill. As a result, the following results were obtained; that is, the characteristic of resistance to softening on softening is the most important factor to improve the life of the tool because the temperature of the tool is raised during its usage; and the wear resistance can be improved by adjusting the grain size of carbides.

The present invention was achieved depending upon the above-shown results and the following three technical discoveries:

(1) The resistance to softening on tempering can be improved satisfactorily by restricting the chemical composition so that W+2Mo, W/2Mo and C-Ceq are within specific ranges. That is, it is effective to increase the quantity of W+2Mo so as to disperse hard carbides and to increase the quantity of alloy elements which are in solid-solution in the matrix.

Furthermore, by increasing the quantity of W to make the ratio of W/2Mo be not less than 1, improved tempering hardness can be obtained. Therefore, further improved resistance to softening on tempering can be obtained in comparison to that realized by a material containing a large amount of Mo.

The content of C must be determined while taking the relationship with the amounts of elements which form the carbides into consideration, the above-described amounts being adjusted by C-Ceq. In order to obtain improved resistance to softening on tempering, C-Ceq must be restricted to maintain the quantity of C which is solid-solutioned in the matrix.

(2) In a case where the hardening temperature is raised for the purpose of placing many alloy elements into the matrix in solid solution, the crystal grains become coarse. The problem of the coarse crystal grains can be prevented by limit the Nb content to restrict the ratio of Nb/V, with the results that fine crystal grains can be obtained and that the deterioration in toughness is prevented. Similarly to V, Nb forms the MC-type carbides, however, Nb must be contained for the purpose of forming fine NbC size with 1 μm or less to effectively prevent the occurrence of coarse crystal grains. It is necessary to make the value of Nb/V be 0.5 or more by weight.

(3) An essential factor of the present invention is the discovery that the improvement in wear resistance can be achieved by raising the density of carbides having grain size of 2 to 5 μm. Medium grain carbides having grain size of 2 to 5 μm are effective to improve the wear resistance. Furthermore, the density of the above-described carbides must be 10000 pieces/mm$^2$ or higher. If the density is lower than the value, the tool can be worn excessively, causing the service life to be shortened. If the density of the medium size carbides having size of 2 to 5 μm exceeds 30000 pieces/mm$^2$, the carbides commence gathering to one another, causing the toughness to be excessively deteriorated. Therefore, the density of the medium size carbides having grain size of 2 to 5 μm is determined to be 10000 to 30000 pieces/mm$^2$.

Furthermore, it is found that the above-shown characteristics can be obtained for the first time when the tool steel has the following composition:

That is, according to an aspect of the present invention, there is provided a high speed tool steel produced by sintering powder, consisting essentially, by weight, of more than 1.5% but not more than 2.2% C, not more than 1.0% Si, not more than 0.6% Mn, 3.0 to 6.0% Cr, an amount of W and/or Mo in which the content of W+2Mo is in the range of 20 to 30% and in which the ratio of W/2Mo is not less than 1, not more than 5.0% V, 2.0 to 7.0% Nb, the ratio of Nb/V being not less than 0.5, and the balance Fe and incidental impurities, the value of C-Ceq, which Ceq is defined by $0.24+0.033\times W+0.063\times Mo+0.2\times V+0.1\times Nb$, being in range of −0.20 to 0.05, the density of carbides having grain of 2 to 5 μm being in a range of 10,000 to 30,000 pieces/mm$^2$.

According to another aspect of the present invention, there is provided a high speed tool steel produced by sintering powder, consisting essentially, by weight, of more than 1.5% but not more than 2.2% C, not more than 1.0% Si, not more than 0.6% Mn, 3.0 to 6.0% Cr, an amount of W and/or Mo in which the content of W+2Mo is in the range of 20 to 30% and in which the ratio of W/2Mo is not less than 1, not more than 5.0% V, 2.0 to 7.0% Nb, the ratio of Nb/V being not less than 0.5, not more than 15.0% preferably not less than 4.0% Co, and the balance Fe and incidental impurities, the value of C-Ceq, which Ceq is defined by $0.24+0.033\times W+0.063\times Mo+0.2\times V+0.1\times Nb$, being in a range of −0.20 to 0.05, the density of carbides having size of 2 to 5 μm being in a range of 10,000 to 30,000 pieces/mm$^2$.

If the quantity of Nb is too large in comparison to that of V, coarse NbC will easily be formed, causing the toughness to be deteriorated. Therefore, it is preferable that the following relationship be held: the ratio of Nb/V is not more than 2.

Furthermore, in order to improve the wear resistance, it is preferable that a relationship that the value of Nb+V is larger than 6 be held.

According to another aspect of the present invention, there is provided a method of producing high speed tool steel produced by sintering powder comprising the steps of: a step of sintering alloy powder to obtain a sintered material, the alloy powder consisting essentially, by weight, of more than 1.5% but not more than 2.2% C, not more than 1.0% Si, not more than 0.6% Mn, 3.0 to 6.0% Cr, an amount of W and/or Mo in which the content of W+2Mo is in the range of 20 to 30% and in which the ratio of W/2Mo is not less than 1, not more than 5.0% V, 2.0 to 7.0% Nb, the ratio of Nb/V being not less than 0.5, not more than 15.0% Co if required, and the balance Fe and incidental impurities, the value of C-Ceq, which Ceq is defined by $0.24+0.033\times W+0.063\times Mo+0.2\times V+0.1\times Nb$, being in a range of −0.20 to 0.05; and a step of performing a heating process at 1100° C. to 1200° C. before or during a hot working.

The essential characteristic of the present invention lies in that the density of carbides having grain size of 2 to 5 μm is 10000 to 30000 pieces/mm$^2$ in order to improve wear resistance while maintaining satisfactory hardness and resistance to softening on tempering. This density of carbides of the specific size cannot be realized simply by specifying the composition but it can be realized by performing the heat treatment such as soaking etc. during or before the hot working.

Fine carbides having size of 2 μm or less are dissolved if carbides are subjected to the heat treatment such as soaking etc., so that the density of the carbides having size of 2 to 5 μm can be raised due to the Ostward growth.

Although the wear resistance can be significantly improved by making the density of the medium size carbides having size of 2 to 5 μm to be 10000 pieces/mm$^2$, the carbides commence gathering if it exceeds 30,000 pieces/mm$^2$, causing the toughness to be deteriorated.

Then, the reason why the composition is made as disclosed above will now be explained.

C contributes to improve the wear resistance because it forms hard carbides in cooperation with Cr, W, Mo, V and Nb. Another effect can be obtained in that it is dissolved into the matrix at the time of austenitizing operation so that the secondary temper hardening is improved. However, if the quantity of C is too large, the quantity of C to be dissolved into the matrix is excessively enlarged, causing the toughness to be deteriorated. Therefore, the quantity of C must be determined while taking upon the relationship with the quantities of Cr, W, Mo, V and Nb into consideration. According to the present invention, the quantity of C is adjusted to a range of 1.5 to 2.2% while making the value of C-Ceq to be −0.20 to 0.50. By making this relation satisfied there is achieved one of the above-shown conditions required to obtain improved resistance to softening on high temperature tempering.

Although Si and Mn are added as deoxidizer, a problem of deterioration in toughness or the like occurs if they are added excessively. Therefore, the quantity of Si is made to be 1.0% or less and as well as that of Mn is made to be 0.6% or less.

Cr is added by a quantity of 3 to 6% in order to improve hardenability and secondary temper hardening characteristics. If it is smaller than 3%, the above-shown effect is reduced. If Cr is larger than 6%, the quantity of carbides of the $M_{23}C_6$ type, the main component of which is Cr, increases excessively, causing the overall toughness to be reduced, and aggregation of carbides is accelerated at the time of tempering, causing the resistance to softening to deteiorated.

In order to realize improved wear resistance, which is one of the objects of the present invention, a large quantity of hard carbides must be dispersed and at the same time the hardness of the matrix must be improved.

The factors of the quantity of W and that of Mo are important factors according to the present invention. The quantity of W or that of W+2Mo is made to be 20 to 30%. If it is smaller than 20%, the above-shown effect is reduced. If W+2Mo exceeds 30%, gathered carbides increase rapidly, causing the alloy elements dissolved in the matrix to be increased excessively, with the result that toughness will be deteriorated very much. Therefore, the quantity of W or that of W+2Mo is made to be 20 to 30%. By limiting the ratio of W/2Mo to be 1 or more, another condition (the remaining one is the condition of C-Ceq) for remarkably improving the resistance to softening on tempering which is the object of the present invention can be met.

V is also able to improve the wear resistance. Although it is preferable to be contained as much as possible for the purpose of improving the wear resistance, coarse MC-type carbides are crystallized if the quantity thereof exceeds 5%, causing toughness and grindability of a tool to be deteriorated. Therefore, it is determined to be 5% or less.

Nb is one of the most important elements in the present invention. If Nb is made to be within a specific composition range, there are crystallized fine and hard carbides, the main component of which is Nb having size of 1 to 5 μm and which is effective to improve the wear resistance, the fine carbides having size of 1 μm or less.

The present inventors, found the facts that the fine NbC is able to prevent the growth of the crystal grains and that the limited range of its content can prevent coarse crystal grains from occurring even if the tempering temperature is raised. The fine NbC closely relates to the quantity of Nb and the ratio of Nb/V. Therefore, if the quantity of Nb and the ratio of Nb/V are small, the fine NbC is hardly crystallized. Thus, the quantity of Nb is adjusted so that the content of Nb is not less than 2% and the ratio of Nb/V is not less than 0.5. If the quantity of Nb exceeds 7%, excessively coarse NbC will be crystallized, causing toughness and grindability to be deteriorated, so that it is made to be 7% or less. Furthermore, if the quantity of Nb is too large in comparison to the quantity of V, the Nb carbides easily become coarse. Therefore, it is preferable that the ratio of Nb/V is made to be not more than 2.

Co is a very effective element to improve the resistance to softening on tempering which is the object of the present invention. It is dissolved into the matrix to delay the precipitation and the aggregation of carbides. As a result, the hardness and the strength at high temperature can be remarkably improved. Therefore, it performs a very important role when it is used in a case where a contact portion, at which a tool such as a cutting tool and an end mill comes in contact with a work, is heated considerably. However, if the content of Co exceeds 15.0%, the single Co-phase is crystallized in the solid-solutioned state, causing toughness to be deteriorated. Therefore, it is made to be not more than 15.0%.

In order to remarkably improve the resistance to softening on tempering by adding Co, it is preferable that Co be added by 4% or more.

BRIEF DESCRIPTION OF THE DRAWINGS

FIG. 1A is a metal structural photograph showing MC-type carbides and FIG. 1B is a metal structural photograph showing $M_6C$-type carbides; FIG. 2A is a metal structural photograph showing MC-type carbides and FIG. 2B is a metal structural photograph showing $M_6C$-type carbides.

DESCRIPTION OF THE PREFERRED EMBODIMENTS

Figure 1A:
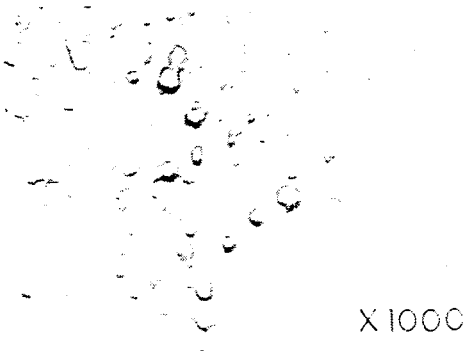
FIGS. 1A and 1B illustrate carbides contained in the structure of steel according to the present invention, where

Table 1 shows the chemical compositions of three kinds of experimental materials produced by subjecting nitrogen gas-atomized powder to HIP (Hot Isostatic Pressing). Each material was subjected to soaking at temperature is a range of 1080° C. to 1190° C. after the HIP process had been completed. Then, each material was elongated by forming so as to be formed into a forged member about 16 mm square before it was annealed at 860° C. Then, the forged member was, for 15 minutes, austenitized at 1250° C. which was the highest temperature below which the occurrence of coarse crystal grains can be prevented. Then, hot bath hardening at 550° C. was performed. Tempering was then performed in such a manner that heating at 560° C. for one hour was carried out three times.

The density of the carbides having grain size of 2 to 5 μm was determined in such a manner that: the surface of vertical cross sections of each forged member was ground with diamond; $M_6C$-type carbides were etched by Murakami reagent; electrolytic etching was performed by using 10% chromate solution to prepare specimens in which the MC-type carbides were etched; and the carbides of the specimens were determined by using an image analyzing device.

Furthermore, the hardness of the tempered specimens were measured, the crystal grain size (after hardening) shown by the intercept method and the hardness (hereinafter called "resistance to softening on tempering") shown after air-cooling which was effected after heating at 650° C. for one hour.

The results of the measurements are shown in Table 2.

TABLE 1

| Sample No. | Chemical composition (wt %) | | | | | | | | | | | | | |
|---|---|---|---|---|---|---|---|---|---|---|---|---|---|---|
| | C | Si | Mn | Cr | W | Mo | V | Nb | Co | Fe | W + 2Mo | W/2Mo | ΔC* | Nb/V |
| 1 | 1.86 | 0.35 | 0.38 | 3.98 | 14.21 | 6.13 | 3.01 | 2.44 | — | Bal | 26.5 | 1.16 | −0.08 | 0.81 |
| 2 | 1.87 | 0.47 | 0.31 | 4.10 | 15.99 | 5.08 | 3.11 | 2.57 | 9.47 | Bal | 26.2 | 1.57 | −0.10 | 0.83 |
| 3 | 1.90 | 0.26 | 0.32 | 4.01 | 14.10 | 6.03 | 3.02 | 2.48 | 9.41 | Bal | 26.2 | 1.17 | −0.04 | 0.82 |

*ΔC is a value of deviation from the value of C-Ceq defined in the present invention.

TABLE 2

| Sample No. | Specimen No. | Soaking condition | Density of carbides having grain size of 2-5 μm (piece/mm²) | Crystal grain size (intercept method) | Hardness (HRC) | Resistance to softening on tempering (HRC) | Kind |
|---|---|---|---|---|---|---|---|
| 1 | 1a | 1080° C. × 2 hr | 7810 | 20.2 | 71.3 | 63.9 | Comparative steel |
| | 1b | 1120° C. × 4 hr | 12020 | 19.4 | 70.8 | 63.4 | Present invention |
| | 1c | 1170° C. × 4 hr | 18470 | 18.9 | 70.5 | 63.3 | Present invention |
| 2 | 2a | 1080° C. × 4 hr | 5670 | 21.9 | 72.3 | 66.6 | Comparative steel |
| | 2b | 1120° C. × 4 hr | 10080 | 20.5 | 71.9 | 66.4 | Present invention |
| | 2c | 1150° C. × 4 hr | 13180 | 19.3 | 71.7 | 66.3 | Present invention |
| 3 | 3a | 1080° C. × 4 hr | 6980 | 21.5 | 71.9 | 66.1 | Comparative steel |
| | 3b | 1120° C. × 4 hr | 11160 | 20.2 | 71.3 | 65.8 | Present invention |
| | 3c | 1150° C. × 4 hr | 14730 | 19.4 | 71.2 | 65.7 | Present invention |
| | 3d | 1170° C. × 4 hr | 18210 | 19.0 | 71.0 | 65.5 | Present invention |
| | 3e | 1190° C. × 4 hr | 22310 | 18.9 | 70.8 | 65.4 | Present invention |

Although the compositions of steel according to corresponding comparative examples 1a, 2a and 3a are alloys within the scope of the chemical composition of the present invention, they had small quantity of the carbides having the medium size of 2 to 5 μm because the soaking temperature was low. It can be understood from Table 2 that the quantity of the carbides having the medium size of 2 to 5 μm can be increased by raising the soaking temperature to a level higher than 1100° C.

By comparing the sample No. 1 containing no Co with Nos. 2 and 3 both containing Co, it can be understood that the containing of Co is appropriate in a tool in which a high temperature portion occurs by cutting or the like because the sample Nos. 2 and 3 containing Co show larger resistance to softening on tempering than that of the material containing no Co.

FIGS. 1 and 2 show photographs of carbide structures of typical specimens.

Figure 1B:
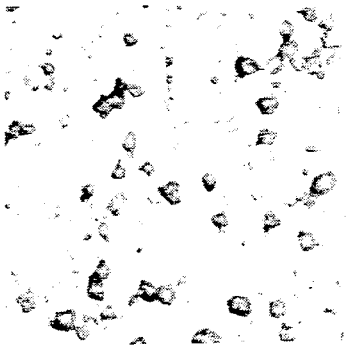

FIG. 1*a* is a photograph of specimen 1*c* according to the present invention and shown in Table 2, the specimen 1*c* being obtainable from polishing the surface with chrome oxide. Referring to the photograph, grains having clear contour are the MC-type carbides existing at a density of 4470 pieces/mm². FIG. 1*b* is a photograph of specimen produced by selectively etching the same material with Murakami reagent. The density of the $M_6C$-type carbides were 14000 pieces/mm².

Figure 2A:
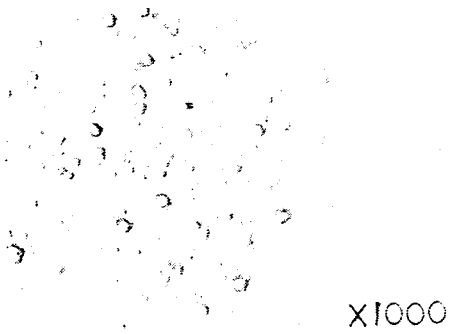
FIGS. 2A and 2B illustrates contained in the structure of steel according to comparative example, where
Figure 2B:
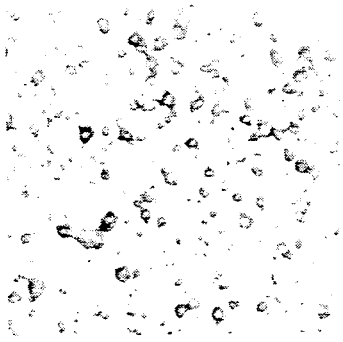

FIG. 2*a* is a photograph of a comparative specimen 1*a* shown in Table 2 and produced by polishing its surface by chrome oxide to emboss the MC-type carbides. The density of the MC-type carbides was 690 pieces/mm². FIG. 2*b* is a photograph of a specimen similarly produced by selectively etching the same material with Murakami reagent. The density of the $M_6C$-type carbides was 7120 pieces/mm².

The toughness of each of these specimens was evaluated by a bending test performed in such a manner that an experimental specimen the size of which was 5 mm in diameter and 70 mm in length was made from the forged member before it was subjected to the heat treatments, that is, hardening and tempering; and the experimental specimens were bent at a span of 50 mm in length.

Furthermore, a point nose straight tool (8-15-6-6-20-15-0.5R, JIS) subjected to the similar heat treatments was subjected to a continuous cutting test performed by cutting steel SKD 61 (JIS) having 40 HRC under conditions shown in Table 3 so that the service life during the cutting operation was measured.

Furthermore, each of the specimens was subjected to the Ogoshi wear resistance test under conditions that the specimens are contacted with corresponding ring made of SCM415 (JIS) under the conditions of friction length of 400 m, final load of 6.8 kgf and friction speed of 3.5 m/S so that the quantity of specific wear was measured.

The results of the experiment are shown in Table 4.

It can be understood from Table 4 that, although the composition is the same, the specimens according to comparative examples 1a, 2a and 3a in each of which the density of the medium size carbides having size of 2 to 5 μm was low show unsatisfactory wear resistance in view of the excessively large quantity specific wear. Furthermore, the service life of the cutting tool during the cutting operation was unsatisfactory.

Furthermore, it can be understood that the specimens of the composition No. 2 and No. 3 each of which contains Co reveal excellent results in terms of the service life of the cutting tool and the quantity of specific wear in comparison to the specimen of the composition No. 1 which contains no Co.

TABLE 3

| | |
|---|---|
| Work to be machined | SKD61 (HRC40) |
| Cutting speed | 42 m/min |
| Feed | 0.1 mm/rev |
| Cut | 1.0 mm |
| | Dry type |

TABLE 4

| Sample No. | Specimen No. | Bending strength (kgf/mm$^2$) | Service life of cutting tool during cutting operation (second) | Quantity of specific wear ($\times 10^{-7}$) | Kind |
|---|---|---|---|---|---|
| 1 | 1a | 303 | 535 | 1.26 | Comparative steel |
| | 1b | 298 | 750 | 1.13 | Steel according to the present invention |
| | 1c | 295 | 820 | 1.08 | Steel according to the present invention |
| 2 | 2a | 287 | 870 | 1.03 | Comparative steel |
| | 2b | 301 | 1005 | 0.92 | Steel according to the present invention |
| | 2c | 292 | 1220 | 0.75 | Steel according to the present invention |
| 3 | 3a | 295 | 790 | 1.03 | Comparative steel |
| | 3b | 312 | 1010 | 0.94 | Steel according to the present invention |
| | 3c | 310 | 1100 | 0.81 | Steel according to the present invention |
| | 3d | 290 | 1230 | 0.72 | Steel according to the present invention |
| | 3e | 285 | 1280 | 0.68 | Steel according to the present invention |

EXAMPLE 2

Experimental materials, the compositions of which were as shown in Table 5, were produced by subjecting nitrogen gas-atomized powder to HIP (Hot Isostatic Pressing). Similarly to Example 1, each material was subjected to soaking at temperature in a range of 1080° C. to 1170° C. after the HIP process had been completed. Then, each material was elongated by forging so as to be formed into a forged member about 16 mm square before it was annealed at 860° C. Then, each of the forged member was austenitized at the highest temperature in which the crystal grains do not become coarse, that is, only specimen 11 was heated at 1210° C. for 15 minutes and other specimens were heated at 1250° C. for 15 minutes. Then, hot bath hardening at 550° C. was performed. Tempering was then performed in such a manner that heating at 560° C. for one hour was carried out three times.

TABLE 5

| Sample No. | Chemical composition (wt %) | | | | | | | | | | | | | | |
|---|---|---|---|---|---|---|---|---|---|---|---|---|---|---|---|
| | C | Si | Mn | Cr | W | Mo | V | Nb | Co | Fe | W + 2Mo | W/2Mo | ΔC | Nb/V | Kind |
| 4 | 1.61 | 0.87 | 0.18 | 4.12 | 20.13 | — | 2.02 | 3.10 | 14.03 | Bal | 20.13 | — | −0.01 | 1.53 | Steel of the invention |
| 5 | 1.75 | 0.62 | 0.25 | 5.61 | 18.03 | 1.98 | 2.47 | 2.99 | 12.11 | Bal | 21.99 | 4.55 | 0.00 | 1.21 | Steel of the invention |
| 6 | 1.94 | 0.32 | 0.31 | 3.48 | 15.82 | 3.96 | 3.45 | 3.38 | 8.03 | Bal | 23.74 | 1.99 | −0.09 | 0.98 | Steel of the invention |
| 7 | 2.00 | 0.13 | 0.32 | 2.34 | 18.14 | 4.01 | 3.72 | 3.41 | 6.13 | Bal | 26.16 | 2.26 | −0.18 | 0.92 | Steel of the invention |
| 8 | 1.80 | 0.55 | 0.33 | 4.13 | 14.13 | 5.27 | 3.11 | 3.02 | 1.93 | Bal | 24.67 | 1.34 | −0.16 | 0.97 | Steel of the invention |
| 9 | 1.87 | 0.41 | 0.31 | 4.20 | 15.97 | 4.01 | 2.12 | 6.01 | 10.03 | Bal | 23.99 | 1.99 | −0.17 | 2.83 | Steel of the invention |
| 10 | 1.67 | 0.43 | 0.32 | 4.13 | 7.92 | 5.09 | 3.53 | 2.50 | — | Bal | 18.10 | 0.78 | −0.11 | 0.71 | Comparative steel |
| 11 | 2.01 | 0.51 | 0.42 | 3.52 | 10.05 | 7.01 | 5.02 | — | — | Bal | 24.07 | 0.72 | −0.01 | 0 | Comparative steel |
| 12 | 2.24 | 0.21 | 0.53 | 4.11 | 14.02 | 5.23 | 3.47 | 4.31 | 8.22 | Bal | 24.48 | 1.34 | +0.08 | 1.24 | Comparative steel |
| 13 | 1.60 | 0.39 | 0.32 | 4.03 | 14.11 | 4.13 | 3.02 | 3.12 | — | Bal | 22.37 | 1.71 | −0.28 | 1.03 | Comparative steel |

Similarly to Example 1, the density of the carbides having grain size of 2 to 5 μm was determined in such a manner that: the surface of vertical cross sections of each forged member was ground with diamond; $M_6C$-type carbides were etched by Murakami reagent; electrolytic etching was performed by using 10% chromate solution to prepare specimens in which the MC-type carbides were etched; and the carbides of the specimens were determined by using an image analyzing device.

Furthermore, the hardness of the tempered specimens, the crystal grain size (after hardening) realized by the intercept method and the hardness (resistance to loss of hardness on tempering) realized by air-cooling after heating at 650° C. for one hour were measured.

The results of the above-described measurements are shown in Table 6.

The toughness of each of the samples was evaluated by a bending test performed in such a manner that an experimental specimen the size of which was 5 mm in diameter and 70 mm in length was made from the forged member before it was subjected to the heat treatments, that is, hardening and tempering; and the experimental specimens were bent at a span of 50 mm in length.

Furthermore, a point nose straight tool (8-15-6-6-20-15-0.5R) subjected to the similar heat treatments was tested by continuously cutting steel SKD61 (JIS) made to have 40 HRC, under conditions shown in Table 3 so that the service life in the cutting operation was measured.

Furthermore, each of the specimens was subjected to the Ogoshi wear resistance test under conditions that it was contacted with the corresponding ring made of SCM415, with friction length of 400 m, with final load of 6.8 kgf and with friction speed of 3.5 m/S, the quantity of specific wear being measured.

The results of the above-described experiment are shown in Table 7.

TABLE 6

| Sample No. | Heat treatment condition* | Density of carbides having grain size of 2-5 μm (piece/mm²) | Crystal grain size (intercept method) | Hardness (HRC) | Resistance to softening on tempering (HRC) | Kind |
|---|---|---|---|---|---|---|
| 4 | a | 10020 | 17.1 | 70.2 | 66.1 | Steel of the invention |
| 5 | a | 12110 | 18.9 | 71.1 | 66.7 | Steel of the invention |
| 6 | a | 15320 | 19.0 | 71.4 | 66.8 | Steel of the invention |
| 7 | a | 17030 | 20.1 | 71.8 | 67.1 | Steel of the invention |
| 8 | a | 13200 | 20.0 | 69.8 | 63.5 | Steel of the invention |
| 9 | a | 16100 | 20.3 | 71.7 | 66.7 | Steel of the invention |
| 10 | a | 9320 | 16.1 | 67.9 | 60.1 | Comparative steel |
| 11 | b | 14130 | 17.7 | 69.2 | 60.0 | Comparative steel |
| 12 | a | 19010 | 20.5 | 72.1 | 65.7 | Comparative steel |
| 13 | a | 12680 | 18.5 | 67.5 | 61.9 | Comparative steel |

a. After austenitizing treatment at 1250° C. for 15 minutes, test piece was cooled in a salt bath at 550° C. and tempered at 560° C. for one hour 3 times.
b. After austenitizing treatment at 1210° C. for 15 minutes, the test piece was cooled in a salt bath at 550° C. and tempered at 560° C. for one hour 3 times.

a. After austenitizing treatment at 1250° C. for 15 minutes, test piece was cooled in a salt bath at 550° C. and tempered at 560° C. for one hour 3 times.

b. After austenitizing treatment at 1210° C. for 15 minutes, the test piece was cooled in a salt bath at 550° C. and tempered at 560° C. for one hour 3 times.

TABLE 7

| Sample No. | Bending strength (kgf/mm²) | Service life of cutting tool in cutting operation (second) | Quantity of specific wear ($\times 10^{-7}$) |
|---|---|---|---|
| 4 | 342 | 980 | 1.02 |
| 5 | 323 | 1110 | 0.93 |
| 6 | 283 | 1300 | 0.87 |
| 7 | 265 | 1420 | 0.71 |
| 8 | 317 | 1280 | 0.91 |
| 9 | 223 | 1010 | 0.70 |
| 10 | 340 | 395 | 1.34 |
| 11 | 303 | 580 | 1.30 |
| 12 | 180 | 990 | 0.87 |
| 13 | 319 | 745 | 1.26 |

Then, each of the specimens will now be explained in detail.

Each of specimen Nos. 4 to 9 of the present invention is steel containing Co so that it contains the medium grain carbides having grain size of 2 to 5 μm in a density range of 10000 pieces/mm² to 20000 pieces/mm².

Each of specimens Nos. 6 to 8 of the present invention contains more than 6% (Nb+V) so that hard MC-type carbides are contained by a relatively large quantity. Therefore, it can be understood that they exhibit excellent service life of the cutting tool while revealing a reduced quantity of specific wear. Furthermore, since Co contained in specimen No. 8 is relatively small, its resistance to softening on tempering is deteriorated in comparison to specimen Nos. 6 and 7. Although specimen No. 9 of the present invention exhibits a satisfactory quantity of specific wear, the value of Nb/V undesirably exceeds 2, that is, the quantity of Nb is relatively large in comparison to the quantity of V, with the result that it contains a large quantity of relatively coarse NbC, causing its bending strength to be deteriorated in comparison to the other specimens. Therefore, it can be understood that it is preferable that the value of Nb/V be 2 or less.

It can be understood that the value of resistance to softening on tempering of specimen No. 10 is too small and thereby the service life of the cutting tool in the cutting operation is excessively shortened in comparison to the specimens according to the present invention because the addition amount of W and Mo in specimen No. 10 is small.

Since specimen No. 11 does not contain Nb, the quenching temperature cannot be raised in order to prevent the occurrence of coarse crystal grains. Therefore, it is impossible to cause alloy elements to be dissolved into the matrix with a sufficient quantity. As a result, satisfactory resistance to softening cannot be obtained. Therefore, the service life of the cutting tool in the cutting operation is very short in comparison to the specimens according to the present invention.

Specimen No. 12 is a specimen having ΔC calculated by C-Ceq which ΔC is a value deviated from the range of the present invention to,,the positive side. In this specimen, C is excessively dissolved into the matrix, so that the deflective strength is unsatisfactorily deteriorated.

Specimen No. 13 is a specimen having ΔC which is deviated from the range of the present invention in the negative side. Since ΔC is too small in this specimen, the hardness cannot be improved in comparison to the specimens of the present invention even if hardening and tempering are performed. Therefore, satisfactory service life of the cutting tool in the cutting operation cannot be realized and the quantity of specific wear cannot be reduced.

According to the present invention, the conventional problem in terms of the resistance to softening on tempering can be significantly improved. Therefore, the wear resistance at high temperature can significantly be improved. In addition, by adjusting the grain size of carbides, the wear resistance can be furthermore improved. Furthermore, since the obtainable toughness is satisfactory in comparison to the conventional material, the service life can be significantly improved under a high speed tool operational condition.

The present invention has been disclosed in its preferred form. The invention, however, is not limited thereto. The scope of the invention is to be determined by the appended claims and their equivalents.

What is claimed is:

1. A sintered high speed tool steel produced by sintering powder, said powder consisting essentially, by weight, of more than 1.5% but not more than 2.2% C, not more than 1.0% Si, not more than 0.6% Mn, 3.0 to 6.0% Cr, an amount of W and Mo in which the content of W+2Mo is in the range of 20 to 30% and in which the ratio of W/2Mo is not less than 1, not more than 5.0% V, 2.0 to 7.0% Nb, the ratio of Nb/V being not less than 0.5, and the balance Fe and incidental impurities, the value of C-Ceq, while Ceq is defined by $0.24+0.033\times W+0.063\times Mo+0.2\times V+0.1\times Nb$, being in a range of −0.20 to 0.05, at least some of the C in said sintered steel being in the form of carbides of grain size 2 to 5 μm, said carbides in said sintered steel having a grain size of 2 to 5 μm being present in an amount in the range of 10,000 to 30,000 pieces/mm$^2$.

2. A sintered high speed tool steel produced by sintering powder, said powder consisting essentially, by weight, of more than 1.5% but not more than 2.2% C, not more than 1.0% Si, not more than 0.6% Mn, 3.0 to 6.0% Cr, an amount of W and Mo in which the content of W+2Mo is in the range of 20 to 30% and in which the ratio of W/2Mo is not less than 1, not more than 5.0% V, 2.0 to 7.0% Nb, the ratio of Nb/V being not less than 0.5, not more than 15.0% Co, and the balance Fe and incidental impurities, the value of C-Ceq, which Ceq is defined by $0.24+0.033\times W+0.063\times Mo+0.2\times V+0.1\times Nb$, being in a range of −0.20 to 0.05, at least some of the C in said sintered steel being in the form of carbides of grain size 2 to 5 μm said carbides in said sintered steel having a grain size of 2 to 5 μm being present in an amount in the range of 10,000 to 30,000 pieces/mm$^2$.

3. A sintered high speed tool steel produced by sintering powder, said powder consisting essentially, by weight, of more than 1.5% but not more than 2.2% C, not more than 1.0% Si, not more than 0.6% Mn, 3.0 to 6.0% Cr, an amount of W and Mo in which the content of W+2Mo is not less than 1, not more than 5.0% V, 2.0 to 7.0% Nb, the ratio of Nb/V being not less than 0.5, 4.0 to 15.0% Co, and the balance Fe and incidental impurities, the value of C-Ceq, which Ceq is defined by $0.24+0.033\times W+0.063\times Mo+0.2\times V+0.2\times Nb$, being in a range of −0.20 to 0.05, at least some of the C being in the form of carbides of grain size 2 to 5 μm said carbides in said sintered steel having a grain size of 2 to 6 μm being present in an amount in the range of 10,000 to 30,000 pieces/mm$^2$.

4. A high speed tool steel produced by sintering powder according to claim 1 or 2, wherein the ratio of Nb/V is not more than 2.

5. A high speed tool steel produced by sintering powder according to claim 1 or 2, wherein the ratio of Nb/V is not more than 2 and the value of Nb+V is more than 6.

6. A method of producing sintered high speed tool steel produced by sintering powder comprising selecting said alloy powder to consist essentially, by weight, of more than 1.5% but not more than 2.2% C, not more than 1.0% Si, not more than 0.6% Mn, 3.0 to 6.0% Cr, an amount of W and/or Mo in which the content of W+2Mo is in the range of 20 to 30% and in which the ratio of W/2Mo is not less than 1, not more than 5.0% V, 2.0 to 7.0% Nb, the ratio of Nb/V being not less than 0.5, and the balance Fe and incidental impurities, the value of C-Ceq, which Ceq is defined by $0.24+0.033\times W+0.063\times Mo+0.2\times V+0.1\times Nb$, being in a range of −0.20 to 0.05;

sintering said alloy powder to obtain a sintered material wherein at least some of the C in said sintered steel being in the form of carbides of grain size 2 to 5 μm; and heating said sintered material at 1100° C. to 1200° C. so that the amount of said carbides having grain size of 2 to 5 μm is in the range of from 10,000 to 30,000 pieces/mm$^2$.

7. A method of producing high speed tool steel produced by sintering powder comprising selecting said alloy powder to consist essentially, by weight, of more than 1.5% but not more than 2.2% C, not more than 1.0% Si, not more than 0.6% Mn, 3.0 to 6.0% Cr, an amount of W and/or Mo in which the content of W+2Mo is in the range of 20 to 30% and in which the ratio of W/2Mo is not less than 1, not more than 5.0% V, 2.0 to 7.0% Nb, the ratio of Nb/V being not less than 0.5, not more than 15.0% Co, and the balance Fe and incidental impurities, the value of C-Ceq, which Ceq is defined by $0.24+0.033\times W+0.63\times Mo+0.2\times V+0.1\times Nb$, being in a range of −0.20 to 0.05;

sintering said alloy powder to obtain a sintered material; and heating said alloy powder at 1100° C. to 1200° C. so that the amount of said carbides having grain size of 2 to 5 μm is in the range of 10,000 to 30,000 pieces/mm$^2$.

8. The method of claim 6 wherein said method includes hot working said material and said heating step is conducted before said hot working.

9. The method of claim 6 wherein said method includes hot working said material and said heating step is conducted during said hot working.

10. The method of claim 7 wherein said method includes hot working said material and said heating step is conducted before said hot working.

11. The method of claim 7 wherein said method includes hot working said material and said heating step is conducted during said hot working.

* * * * *

UNITED STATES PATENT AND TRADEMARK OFFICE

CERTIFICATE OF CORRECTION

PATENT NO. : 5,252,119
DATED : October 12, 1993
INVENTOR(S) : JUNICHI NISHIDA et al.

It is certified that error appears in the above-indentified patent and that said Letters Patent is hereby corrected as shown below:

Claim 3, col. 14, line 1, change "6μm" to --5μm--.

Claim 6, col. 14, line 11, change "comprising" to --comprising:--;

Claim 7, col. 14, line 33, change "comprising" to --comprising:--;

line 37, change "and/or" to --and--;

line 48, before "; and", insert --wherein at least some of the C in said sintered steel being in the form of carbides of grain size 2 to 5 μm--.

Signed and Sealed this

Nineteenth Day of April, 1994

Bruce Lehman

*Attest:*

BRUCE LEHMAN

*Attesting Officer*

*Commissioner of Patents and Trademarks*